US006068513A

United States Patent [19]

Cameron et al.

[11] Patent Number: 6,068,513

[45] Date of Patent: May 30, 2000

[54] DC CONNECTION METHOD

[75] Inventors: Robert Fraser Cameron, Vancouver; Samson Chun-Tat Wong, Coquitlam; Jarmo Kalevi Venalainen, Burnaby, all of Canada

[73] Assignee: Statpower Technologies Partnership, Canada

[21] Appl. No.: 08/914,617

[22] Filed: Aug. 19, 1997

[51] Int. Cl.[7] ..... H01R 13/66

[52] U.S. Cl. ..... 439/620; 439/660

[58] Field of Search ..... 439/620, 660; 174/50.53, 5.54

[56] References Cited

U.S. PATENT DOCUMENTS

| | | | |
|---|---|---|---|
| 1,359,280 | 11/1920 | Schwartz | 439/699.1 |
| 2,174,382 | 9/1939 | Elder et al. | 174/50.54 |
| 3,717,805 | 2/1973 | Gnaedinger et al. | 321/8 R |
| 4,186,339 | 1/1980 | Finger | 324/142 |
| 4,872,102 | 10/1989 | Getter | 363/141 |
| 5,133,668 | 7/1992 | Brown, IV | 439/620 |
| 5,170,336 | 12/1992 | Getter et al. | 363/141 |
| 5,266,055 | 11/1993 | Naito et al. | 439/620 |
| 5,293,145 | 3/1994 | Rynkiewicz | 336/65 |
| 5,409,401 | 4/1995 | Schaarschmidt et al. | 439/620 |
| 5,600,550 | 2/1997 | Cook, II | 363/58 |

OTHER PUBLICATIONS

Product Brochure—Statpower Techologies Corporation. PROwatt line of power inverters. Copyright ©1996. Printed in Canada.

Product Brochure—Statpower Technologies Corporation. PROsine line of power inverters. Copyright ©1995. Printed in Canada.

Product Brochure—Statpower Techologies Corporation. PROsine Inverter Chargers Copyright ©1997. Printed in Canada.

*Primary Examiner*—Renee Luebke
*Assistant Examiner*—J. F. Duverne
*Attorney, Agent, or Firm*—Fulbright & Jaworski L.L.P.

[57] ABSTRACT

An apparatus for high current DC conductor termination. The apparatus includes a base, an insulated terminal projection, first and second opposing connectors, and first and second bus bars. The base is securable to an electrical device. The insulated terminal projection extends from the base and has first and second opposite sides. The first and second opposing connectors are mounted on the opposite sides respectively of the terminal projection, the first and second opposing connectors being substantially in line and operable to connect to first and second conductors respectively. The first and second bus bars are connected to the first and second connectors and extend closely adjacent each other inside the base and are operable to connect to the electrical device for electrical current conduction.

2 Claims, 3 Drawing Sheets

DC CONNECTION METHOD

BACKGROUND OF THE INVENTION

The present invention relates to a compact high current DC connector and more specifically to connection terminals permitting connection of large gauge cables to electrical devices such as DC-AC inverters.

High current devices such as DC-AC inverters require the connection of large gauge cables. Connectors are located on these devices which are mounted in a wide variety of places such as on or under shelves in a recreational vehicle or boat or behind a seat in a truck. As such, flexibility in the orientation of cable connections is important.

Existing connection terminals for high current devices generally involve the use of studs or lugs located side-by-side on one surface of the device. The studs are threaded metal rods which accept ring-type electrical connectors attached to the ends of the cables. In most cases the rods are connected to copper bus bars and the ring type connectors are held in place on the studs with nuts and washers. Lugs are assemblies which have openings to accept the bare ends of the connecting cables, and generally have a screw or other compression device to apply pressure to a cable end to hold the cable end in the lug assembly. Studs tend to be the more popular connection terminals as installers prefer the use of ring terminals to terminate cables.

One alternative to improve flexibility in cable orientation is to position studs diagonally across a high current device rather than side-by-side. However, this arrangement takes up more space and often allows less than 360° of connection orientation since the cables can interfere with the air flow from a fan or vent in the casing of the device.

One of the problems with existing positioning of high current connectors results because they generally extend from the same planar surface and this constitutes a hazard since a screw driver or wrench can directly short circuit the two connectors. Some form of connector cover may be needed. Such a cover may restrict cable orientations and adds additional cost to the device. Furthermore, with existing connectors the individual connectors are relatively far apart and thus make it difficult to add Electromagnetic Interface (EMI) filtering to the connectors or leads to the connectors. For example, the addition of a common mode choke to most high current connectors is difficult because the connectors are not positioned sufficiently close together to permit a ferrite ring to fit around them.

BRIEF SUMMARY OF THE INVENTION

In accordance with one aspect of the invention, there is provided an apparatus for high current DC conductor termination. The apparatus includes a base, an insulated terminal projection, first and second opposing connectors, and first and second bus bars. The base is securable to an electrical device. The insulated terminal projection extends from the base and has first and second opposite sides. The first and second opposing connectors are mounted on the opposite sides respectively of the terminal projection, the first and second opposing connectors being substantially in line and operable to connect to first and second conductors respectively. The first and second bus bars are connected to the first and second connectors and extend closely adjacent each other inside the base and are operable to connect to the electrical device for electrical current conduction.

Preferably, the terminal projection has first and second faces facing outwardly of the projection, the first and second connectors being mounted on the first and second faces.

Preferably, the first and second faces are substantially parallel and spaced apart from each other such that the faces face in opposite directions.

Preferably, the projection extends generally at right angles to the base.

Preferably, the apparatus includes an electromagnetic interference filter electrically connected to the first and second bus bars, the electromagnetic interference filter being disposed closely adjacent the first and second connectors.

Preferably, the electromagnetic interference filter includes first and second capacitive filters connected to the first and second bus bars in spaced apart relation, and a ferrite ring encircling the bus bars.

Preferably, the ferrite ring is disposed between the first and second capacitive filters.

Preferably, the first capacitive filter includes a first circuit board having first and second conducting pads and preferably, the first and second bus bars have first and second contact points for contacting the first and second pads on the first circuit board such that the first circuit board is connected directly to the first and second bus bars.

Preferably, the insulated terminal projection and base is a unitary plastic molded unit.

Preferably, the opposing connectors include first and second threaded studs respectively.

In accordance with another aspect of the invention, there is provided a method of terminating high current DC conductors. The method includes the steps of:

a) connecting first and second high current DC conductors to substantially in-line first and second opposing connectors respectively on opposite sides respectively of an insulated terminal projection connected to a base securable to an electrical device;

b) conducting current to or from the first and second high current DC connectors to or from the electrical device by first and second bus bars extending closely adjacent each other inside the base and terminating in the electrical device.

Preferably, the method further includes the step of filtering signals on the first and second bus bars to reduce electromagnetic interference.

Preferably, the method further includes the step of encircling the bus bars with a ferrite ring and capacitively coupling the first and second bus bars together and to a signal ground terminal of the electrical device, on each side of the ferrite ring.

Preferably, the method further includes the step of urging a first circuit board against the first and second bus bars such that first and second pads on the first circuit board are in direct electrical contact with the first and second bus bars respectively.

BRIEF DESCRIPTION OF THE SEVERAL VIEWS OF THE DRAWING

In drawings which illustrate embodiments of the invention.

DETAILED DESCRIPTION OF THE INVENTION

Figure 1:
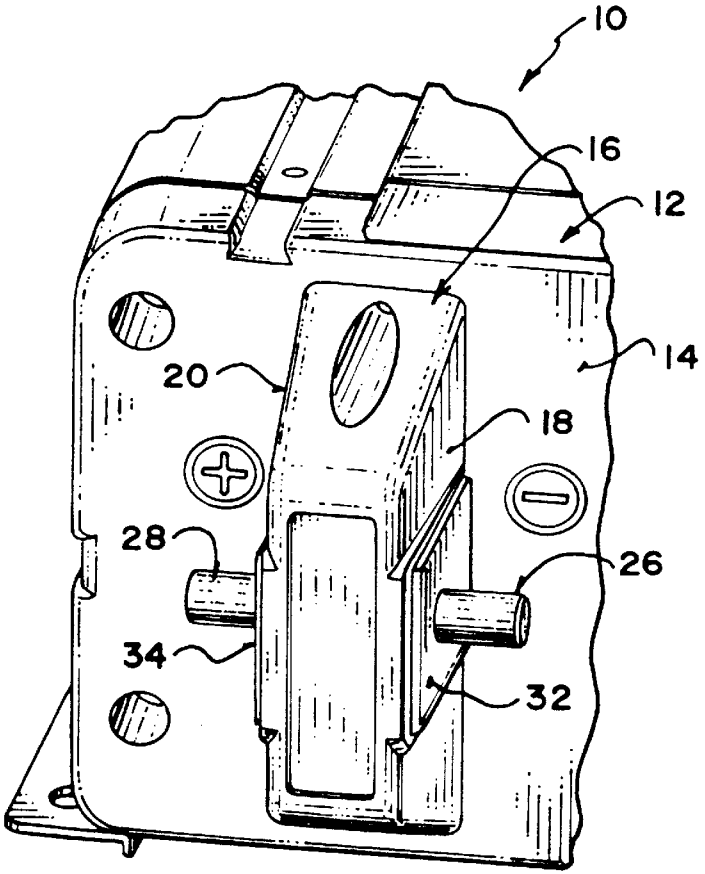
FIG. 1 is an isometric view of an apparatus for high current DC conductor termination, according to a first embodiment of the invention.

Referring to FIG. 1, an apparatus according to a first embodiment of the invention is shown generally at 10. The apparatus includes a cover portion 12, which forms a portion of a cover of an electrical device such as a DC to AC inverter, or the like. The cover portion 12 has a flat planar, exterior surface 14 and an insulated terminal projection shown generally at 16 extending generally at right angles to the flat planar exterior surface 14. The cover portion thus acts as a base of the apparatus, the base being securable to the electrical device. The insulated terminal projection and base are a unitary plastic molded unit.

The projection 16 has first and second substantially parallel opposing faces 18 and 20, tapered at a slight angle to the exterior surface 14 and which face outwardly of the projection 16. The first and second faces are thus substantially parallel and spaced apart from each other such that the faces face in generally opposite directions.

FIG. 2

First and second bus bars 32 and 34 extend closely adjacent each other on opposite sides of the projection, adjacent the first and second opposing faces 18 and 20 respectively. Each bus bar has an exterior portion 36 and 38 respectively, which extends exterior from the cover portion 12 adjacent the opposing faces 18 and 20 of the projection 16. In this embodiment, first and second mounting studs 26 and 28 are secured and mounted to the exterior portion 36 and 38 of the first and second bus bars 32 and 34 respectively. The first and second mounting studs are opposite and in line, for mechanically securing wire ring terminals (not shown) or the like, to the first and second bus bars 32 and 34. The first and second mounting studs thus act as first and second opposing connectors on opposite sides respectively of the terminal projection, the first and second opposing connectors being substantially in line and operable to connect to first and second conductors respectively.

The first and second bus bars 32 and 34 also have first and second interior portions 44 and 46 respectively which extend inside the cover portion 12, that is, they extend inside the device to which the connection terminals are connected. The first and second bus bars are thus connected to the first and second connectors, the first and second bus bars extending closely adjacent each other inside the base and being operable to connect to the electrical device for electrical current conduction. The interior portions of the bus bars 32 and 34 have respective filter portions shown generally at 48 and 50 and have circuit connection portions 52 and 54 for connecting the bus bars to circuit components inside the device apparatus to which the cover portion 12 is connected. It will be appreciated that the filter portions 48 and 50 are disposed closely adjacent to the exterior portions 36 and 38 and are thus disposed closely adjacent to the first and second mounting studs 26 and 28 respectively.

Each of the first and second filter portions has stamped protrusions 56 and 58 which project generally inwardly between the first and second filter portions 48 and 50 and which act as contact points to make contact with a first printed circuit board 60 inserted between the first and second filter portions 48 and 50. A boss 62 is formed in the cover portion 12 to receive a screw for mechanically anchoring the first printed circuit board 60 between the first and second bus bars.

FIG. 3

Figure 2:
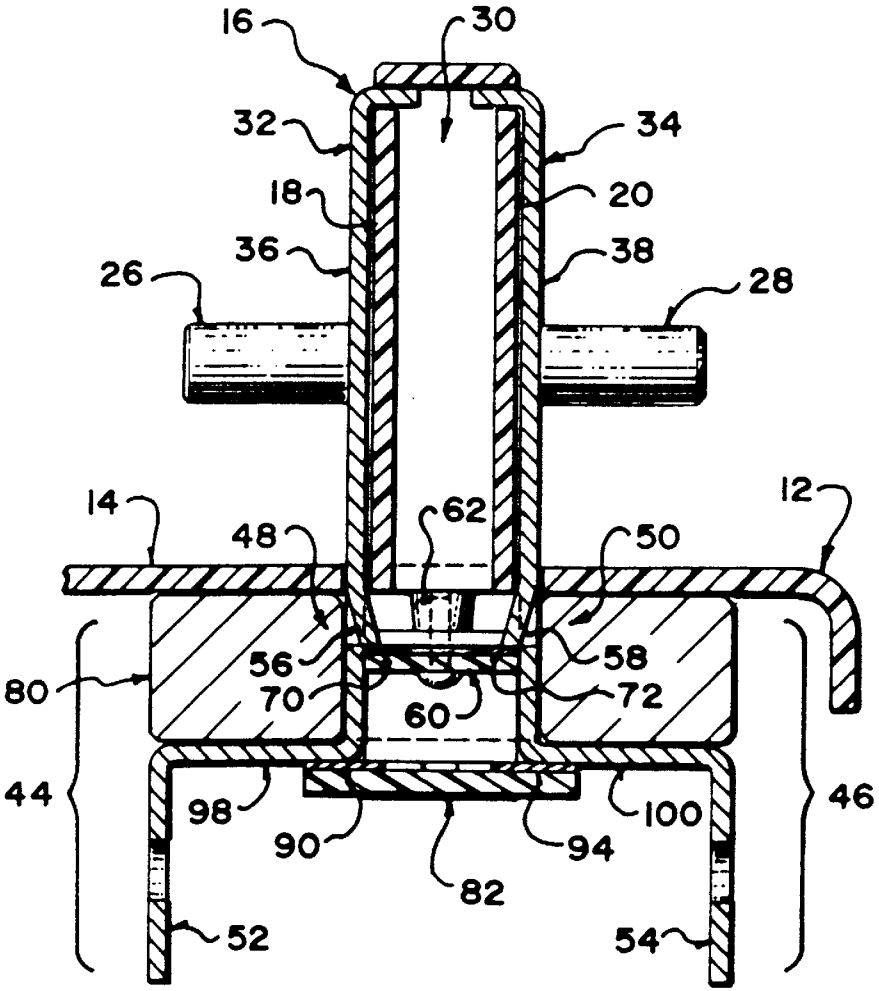
FIG. 2 is a top sectional view through the apparatus shown in FIG. 1.
Figure 3:
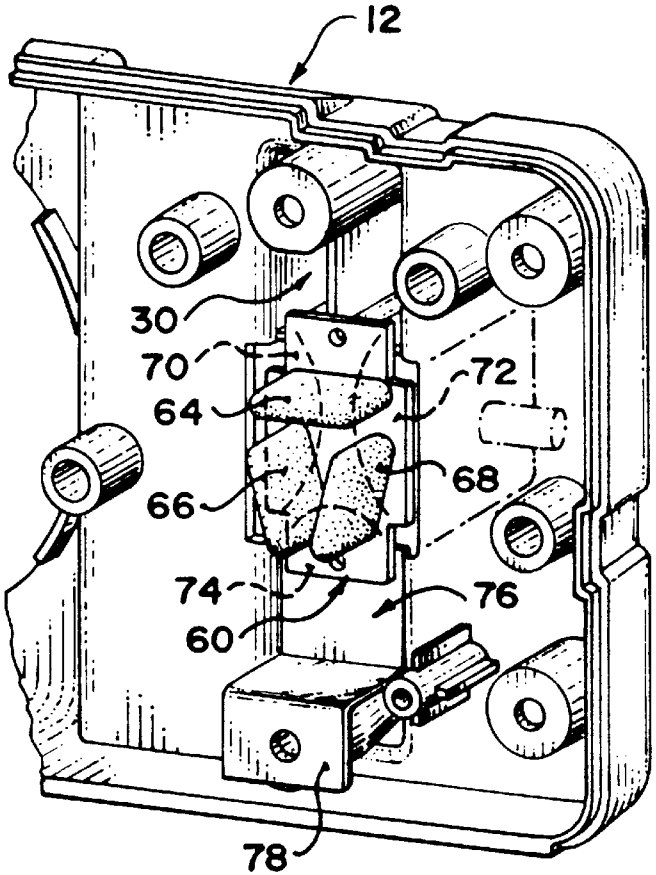
FIG. 3 is an isometric view showing an interior of the apparatus shown in FIG. 1 in a first stage of assembly.

Referring to FIG. 3, the first printed circuit board 60 has first, second and third capacitors 64, 66 and 68 which are connected to pads 70 and 72, on a solder side of the first printed circuit board 60. Referring back to FIG. 2, the solder side of the first printed circuit board 60 is in contact with the first and second stamped protrusions 56 and 58 and, therefore, these protrusions make contact with the first and second pads 70 and 72 respectively. Referring back to FIG. 3, the first printed current board 60 has a third pad 74 to which is connected a signal ground bracket shown generally at 76, for connecting the third pad 74 to signal ground through an enclosure contacting surface 78 of the signal ground bracket 76.

FIG. 4

Figure 4:
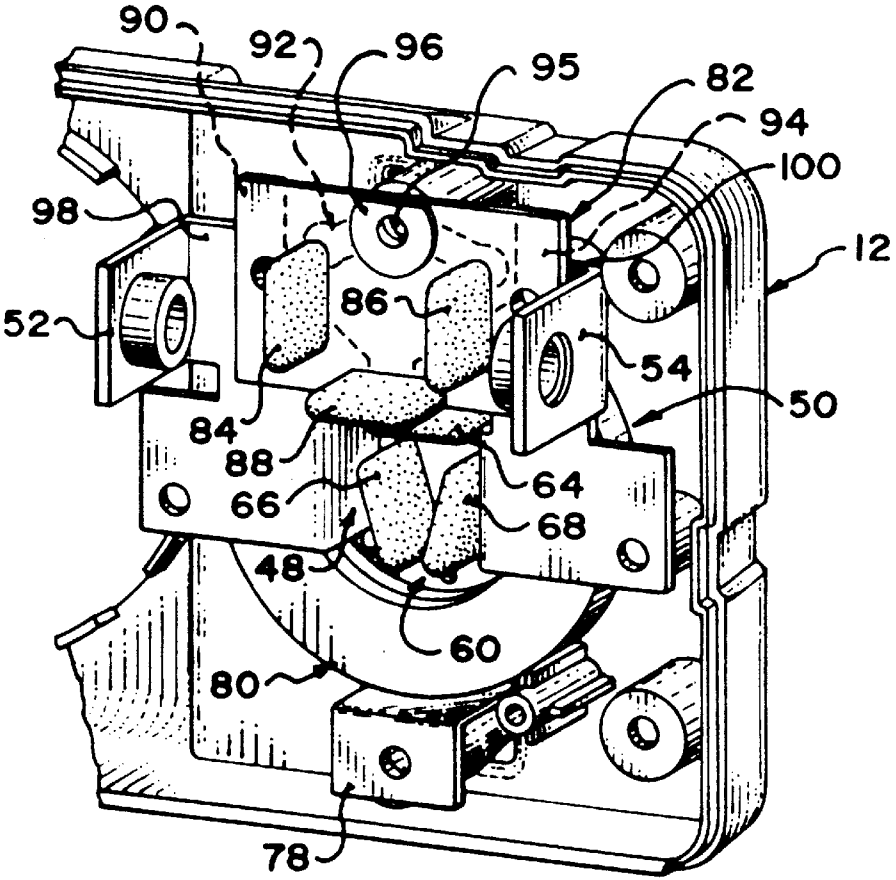
FIG. 4 is an isometric view showing an interior of the apparatus shown in FIG. 1 in a second stage of assembly.

Referring to FIG. 4, a ferrite ring shown generally at 80 is installed to encircle the first and second filter portions 48 and 50 of the bus bars 32 and 34 such that the first printed current board 60 is disposed between the cover portion 12 and the ferrite ring 80.

Still referring to FIG. 4, a second printed circuit board 82 having fourth, fifth and sixth capacitors 84, 86, and 88 and first, second and third printed circuit board traces 90, 92 and 94 on a solder side of the second printed circuit board 82 and has a fourth trace 96 on the component side of the second printed circuit board 82, the fourth trace 96 being through-hole plated to the second trace 92 to make connection therewith. The capacitors 84, 86 and 88 are connected to the traces 90, 92 and 94 and the traces 90 and 94 are connected directly to inwardly facing surfaces 98 and 100 of the bus bars 32 and 34. Thus, the second printed circuit board 82 is mounted such that the ferrite ring 80 is between the first and second printed circuit boards 60 and 82.

A signal ground connection is made through hole 95 between the fourth pad 96 and the chassis of the unit to which the cover is connected.

FIG. 5

Figure 5:
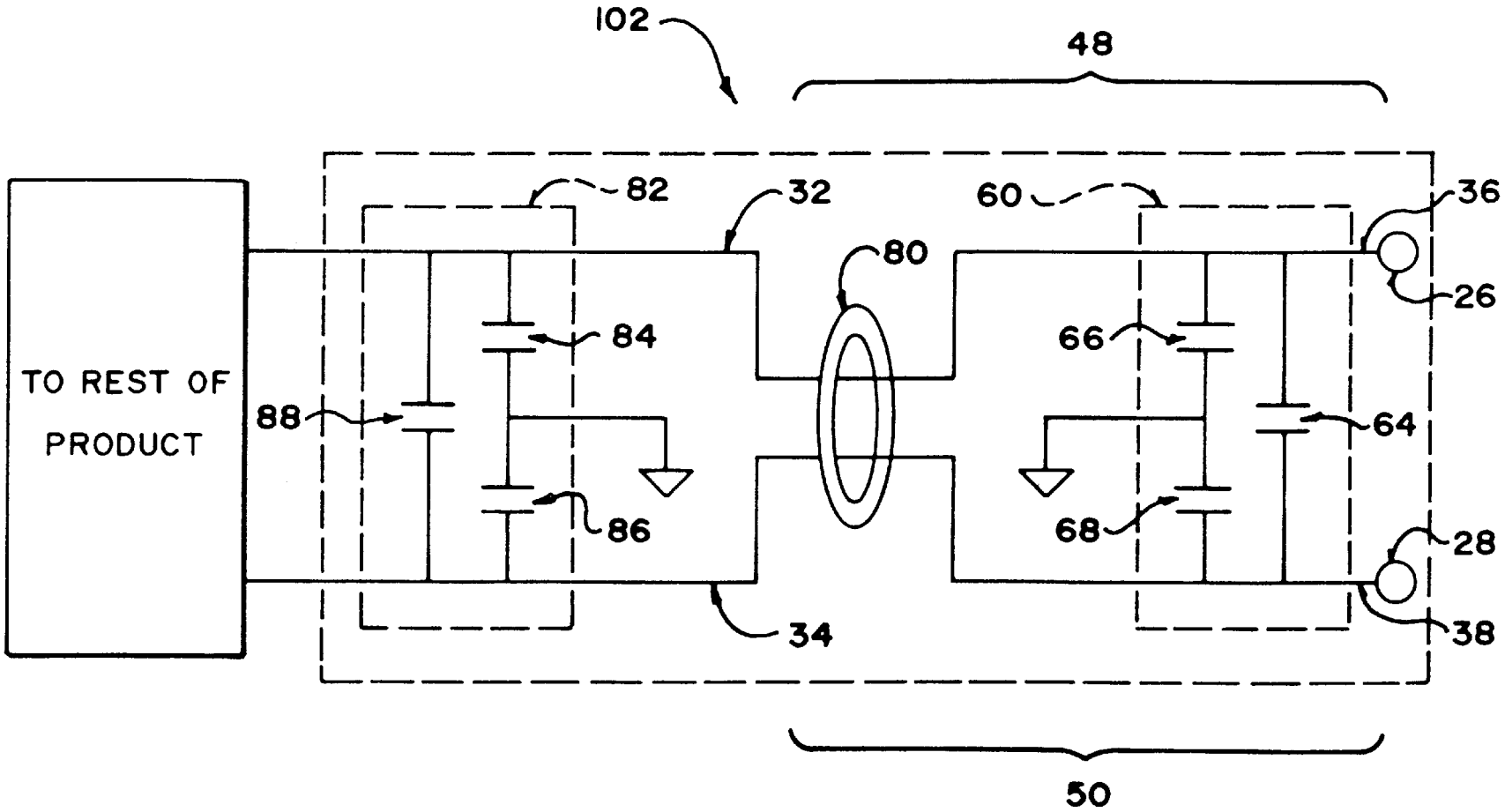
FIG. 5 is a schematic diagram of a filter according to the first embodiment of the invention.

Referring to FIG. 5, an electrical schematic diagram of the first and second printed circuit boards 60 and 82 and the bus bars 32 and 34 is shown generally at 102. Effectively, the first printed circuit board 60 is electrically connected between filter portions 48 and 50 of the copper bus bars such that the first capacitor 64 is connected between the bus bars, the second capacitor 66 is connected between the first bus bar 32 and the signal ground, or chassis ground and the third capacitor 68 is connected between chassis ground and the second copper bus bar 34, in a location between the first and second mounting studs 26 and 28 and the ferrite ring 80.

In addition, the second printed circuit board 82 is connected to the first and second bus bars 32 and 34 such that the sixth capacitor 88 is connected between the first and second bus bars 32 and 34, the fourth capacitor 84 is connected between the first bus bar 32 and signal ground and the fifth capacitor 86 is connected between signal ground and the second bus bar 34. The second printed circuit board 82 is electrically connected to the bus bars 32 and 34 at a location between the device to which the apparatus is connected and the ferrite ring 80.

The effect of the first and second printed circuit boards 60 and 82 is to provide first and second electromagnetic interference filter stages on opposite sides of the ferrite ring 80 on the bus bars 32 and 34 closely adjacent the first and second connectors. This reduces electromagnetic interference from being conducted by the connectors to equipment connected thereto.

As the pads on the first and second printed circuit boards 60 and 82 are directly in contact with the bus bars 32 and 34, any inductance in connecting the capacitors to the bus bars is minimized. The short foil traces of the pads on the printed circuit boards have very minimal inductance. Also, as the configuration of the first and second printed circuit boards 60 and 82 and ferrite ring 80 relative to the bus bars 32 and 34 results in the bus bars being positioned relatively closely adjacent and parallel to each other, any loop area bounded by the bus bars is kept to a minimum and therefore, radiation of electromagnetic interference is kept to a minimum.

In addition, the disposition of the first and second mounting studs 26 and 28, opposite each other eliminates the possibility of wires connected to the studs from coming in contact with each other and eliminates the possibility of tools being dropped on the projection 16 and coming into contact with both the first and second studs at the same time thereby eliminating the possibility of an electrical short circuit between the studs. In addition, the first and second mounting studs 26 and 28 extend generally parallel to the exterior surface 14 of the cover portion 12 and thus allow connecting wires to be connected to the studs such that the connecting wires extend at virtually any angle within 180 degrees range on the exterior surface 14. This allows flexibility in mounting the device to which the cover portion 12 is connected, thus increasing the versatility of the device.

Operation

Effectively, the user connects first and second high current DC conductors to the substantially in-line first and second opposing studs 26 and 28 respectively on opposite sides respectively of the insulated terminal projection 16 connected to the base 14 securable to an electrical device.

Current is conducted to or from the external portions 36 and 38 of the bus bars to or from the electrical device by the remainder of the first and second bus bars 32 and 34 which extend closely adjacent each other inside the projection 16 and which terminate in the electrical device. Signals on the first and second bus bars are filtered to reduce electromagnetic interference by encircling the bus bars with a ferrite ring and capacitively coupling the first and second bus bars together and to a signal ground terminal of the electrical device, on each side of the ferrite ring. A first circuit board is urged against the first and second bus bars such that first and second pads on the first circuit board are in direct electrical contact with the first and second bus bars respectively.

While specific embodiments of the invention have been described and illustrated, such embodiments should be considered illustrative of the invention only and not as limiting the invention as construed in accordance with the accompanying claims.

What is claimed is:

1. An apparatus for high current conductor termination, the apparatus comprising:

a) a base securable to an electrical device;

b) an insulated terminal projection extending from said base, said insulated terminal projection having first and second opposite sides;

c) first and second opposing connectors on said opposite sides respectively of said terminal projection, said first and second opposing connectors being substantially in line and operable to connect to first and second conductors respectively.

d) first and second bus bars connected to said first and second connectors, said first and second bus bars extending closely adjacent each other inside said projection and being operable to connect to said electrical device for electrical current conduction, said first and second bus bars having first and second contact points e) an electromagnetic interference filter electrically connected to said first and second bus bars, said electromagnetic interference filter being disposed closely adjacent said first and second connectors, said electromagnetic interference filter including first and second capacitive filters connected to said first and second bus bars in spaced apart relation, and a ferrite ring encircling said bus bars, said first capacitive filter including a first circuit board having first and second conducting pads operable to contact said first and second contact points respectively such that said first circuit board is connected directly to said first and second bus bars and said ferrite ring is disposed between said first and second capacitive filters.

2. A method of terminating high current conductors, the method comprising the steps of:

a) connecting first and second high current conductors to substantially in-line first and second opposing connectors respectively on opposite sides respectively of an insulated terminal projection connected to a base securable to an electrical device; and b) conducting current to or from said first and second high current connectors to or from said electrical device by first and second bus bars extending closely adjacent each other inside said projection and terminating in said electrical device.

c) filtering signals on said first and second bus bars to reduce electromagnetic interference by encircling said bus bars with a ferrite ring and capacitively coupling the first and second bus bars together and to a signal ground terminal of said electrical device, by urging a first circuit board, on which capacitors are mounted against said first and second bus bars such that first and second pads in connection with said capacitors on said first circuit board are in direct electrical contact with said first and second bus bars respectively.

* * * * *